US007328959B2

(12) United States Patent
Chun

(10) Patent No.: US 7,328,959 B2
(45) Date of Patent: Feb. 12, 2008

(54) METHOD OF APPARATUS FOR MEASURING IMAGE ALIGNMENT ERRORS FOR IMAGE FORMATION IN IMAGE FORMING APPARATUS

(75) Inventor: Young-sun Chun, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/611,422

(22) Filed: Jul. 2, 2003

(65) Prior Publication Data

US 2004/0056914 A1 Mar. 25, 2004

(30) Foreign Application Priority Data

Jul. 25, 2002 (KR) ..... 10-2002-0043861

(51) Int. Cl.
*B41J 29/393* (2006.01)

(52) U.S. Cl. ..... 347/19

(58) Field of Classification Search ..... 347/19, 347/37; 400/74

See application file for complete search history.

(56) References Cited

U.S. PATENT DOCUMENTS 5,250,956 A * 10/1993 Haselby et al. ..... 347/19
6,109,721 A 8/2000 Kim
6,193,350 B1 2/2001 Hadley
6,607,260 B1 * 8/2003 Ikeda ..... 347/19
6,609,777 B2 * 8/2003 Endo ..... 347/19

FOREIGN PATENT DOCUMENTS

| | | |
|---|---|---|
| CN | 1169551 | 1/1998 |
| CN | 1347368 | 5/2002 |
| EP | 0813973 | 12/1997 |
| EP | 1195247 | 4/2002 |
| JP | 7-323582 | 12/1995 |

* cited by examiner

*Primary Examiner*—Julian D. Huffman
(74) *Attorney, Agent, or Firm*—Staas & Halsey LLP

(57) ABSTRACT

A method of and an apparatus for measuring image alignment errors for image formation includes printing two test marks separated from each other by a designated error distance on a printing medium on which images are printed, sensing the two test marks, measuring instants of time when the two test marks are sensed, and detecting an actual error distance of the two test marks using the measured instants of time and a moving speed of a carriage.

6 Claims, 4 Drawing Sheets

①
② t1
m
t2

METHOD OF APPARATUS FOR MEASURING IMAGE ALIGNMENT ERRORS FOR IMAGE FORMATION IN IMAGE FORMING APPARATUS

CROSS-REFERENCE TO RELATED APPLICATIONS

This application claims the priority of Korean Patent Application No. 2002-43861, filed on Jul. 25, 2002, in the Korean Intellectual Property Office, the disclosure of which is incorporated herein in its entirety by reference.

BACKGROUND OF THE INVENTION

1. Field of the Invention

The present invention relates to method of and apparatus for measuring image alignment errors for image formation, by which test mark errors are more precisely measured using only two test marks, and more particularly, to method of and apparatus for checking an alignment of required test marks so that an image alignment of an image forming apparatus is corrected.

2. Description of the Related Art

In general, when an ink-jet image forming apparatus (for example, an ink-jet printer) performs a printing operation of an image, errors may occur in an image alignment. These errors cause a low printing quality due to a great variety of factors, such as non-uniformity of traveling of an ink-jet cartridge, a mechanical distortion, or a delay time of ink ejection. In the related art, a plurality of test marks are provided such that a user can check in advance the alignment state of images to correct errors.

FIGS. 1A and 1B show views in which a plurality of test marks for checking image alignment errors and correcting the image alignment errors are printed. In the related art, in order to correct errors in an image alignment, the test marks are printed. The test marks are divided into first test mark patterns for checking an alignment state on a horizontal axis as shown in FIG. 1A, and second test mark patterns for checking another alignment state on a vertical axis as shown in FIG. 1B. In general, several tens of the first or second test marks are provided to check the alignment state on the horizontal axis or the vertical axis. A user selects a test mark having a highest alignment state from the printed first or second test marks. Then, a correction operation is performed using an image forming apparatus in which the user selection is reflected. In first test mark patterns of FIG. 1A, the alignment state of a test mark 5 is the highest one of the first marks, and in second test mark patterns of FIG. 1B, the alignment state of a test mark 4 is the highest one of the second test marks. Thus, the user selects the test marks 4 and 5 such that a correction operation is properly performed.

However, in the related art, the user should check the first or second test marks to detect the alignment state of the test marks. Since this operation is performed with naked eyes of the user, it is time consuming, and the user easily gets tired. Also, improper test marks may be selected by the user.

SUMMARY OF THE INVENTION

The present invention provides a method of measuring image alignment errors for image formation, by which errors in image alignment are easily measured at an arbitrary position using only two test marks, even though a user does not check each alignment state of a plurality of test marks.

The present invention also provides an apparatus for measuring image alignment errors for image formation a method of measuring image alignment errors for image formation].

Additional aspects and advantages of the invention will be set forth in part in the description which follows and, in part, will be obvious from the description, or may be learned by practice of the invention.

According to an aspect of the present invention, a method of measuring image alignment errors for image formation in an ink-jet image forming apparatus having a carriage includes printing two test marks separated from each other by a designated error distance on a printing medium on which images are printed, sensing the two test marks, measuring instants of time when the two test marks are sensed, and detecting an actual error distance of the two test marks using the measured instants of time and a moving speed of the carriage.

According to another aspect of the present invention, an apparatus for measuring image alignment errors for image formation in an ink-jet image forming apparatus having a carriage includes a test mark print-directing unit which directs to print two test marks separated from each other by a designated error distance on a printing medium on which images are printed, a test mark sensing unit which senses the two test marks and outputs a sensing result, a reference clock generating unit which generates a reference clock and outputs the generated reference clock, a sensed instant of time measuring unit which compares the sensed result of the two test marks with the generated reference clock to measure instants of time when the two test marks are sensed, and outputs the measured instants of time, and an error distance detecting unit which detects an actual error distance of the two test marks using the measured instants of time and a moving speed of the carriage, and outputs the detected actual error distance.

According to another aspect of the present invention, an apparatus for measuring an image alignment error for image formation in an image forming apparatus having a carriage includes a test mark print-directing unit which prints two test marks on a printing medium according to a designated error distance, and an error distance detecting unit which detects an actual error distance of the first and second test marks to compensate for the image alignment error according to the detected actual error distance and the designated error distance.

According to another aspect of the present invention, a method of measuring an image alignment error for image formation in an image forming apparatus having a carriage includes printing two test marks on a printing medium according to a designated error distance, and detecting an actual error distance of the first and second test marks to compensate for the image alignment error according to the detected actual error distance and the designated error distance.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1A:
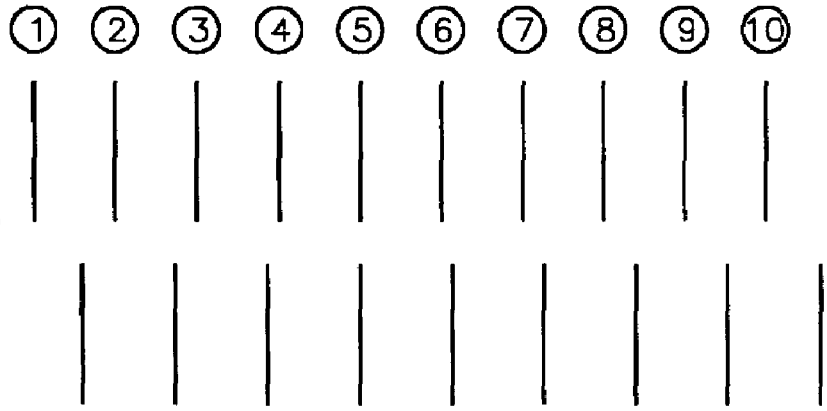
FIG 1A (PRIOR ART)
FIGS. 1A and 1B show views in which a plurality of test marks for checking and correcting image alignment errors are printed in a conventional image forming apparatus.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 2:
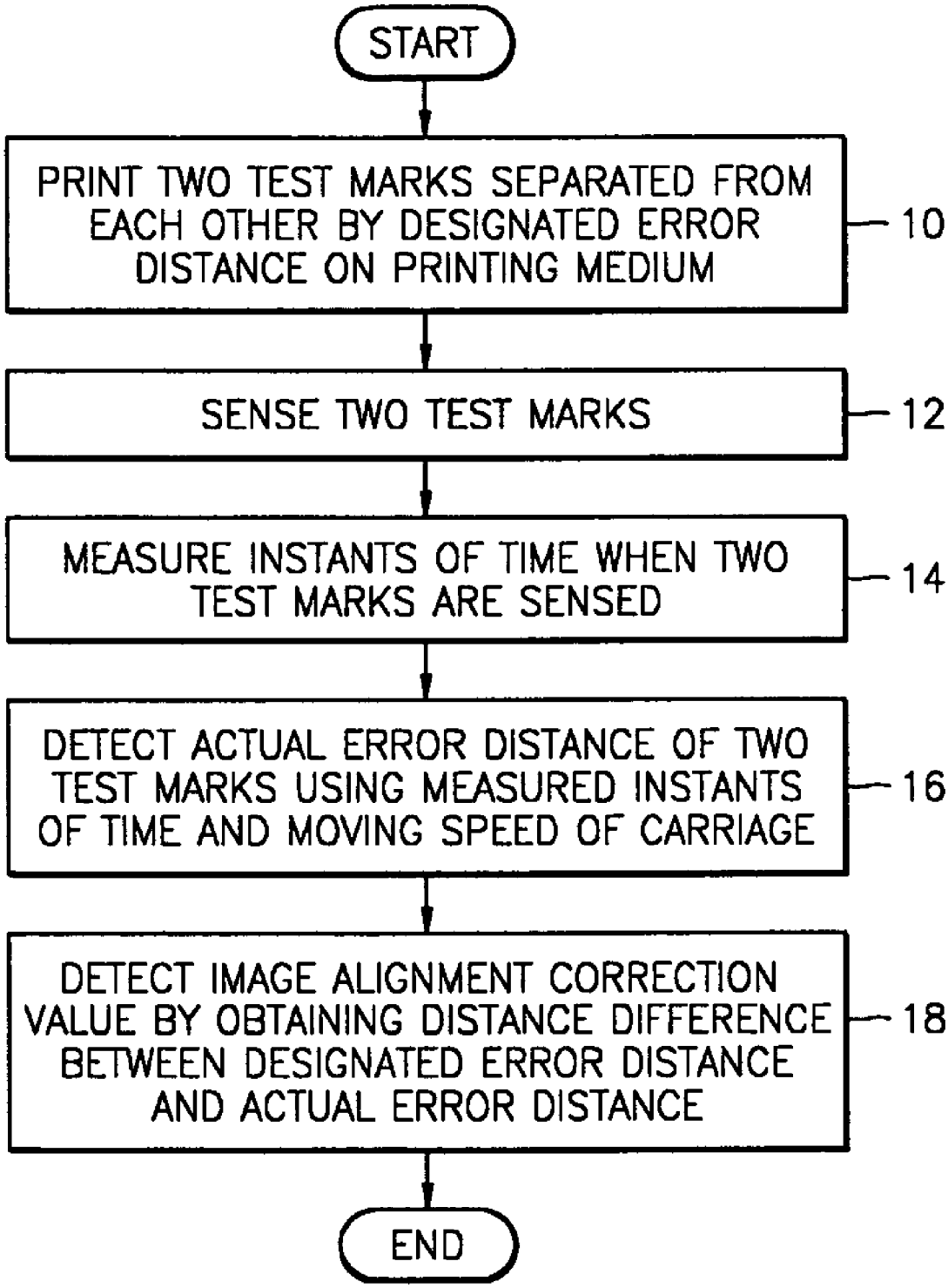
FIG. 2 is a flowchart illustrating a method of measuring image alignment errors for image formation according to an embodiment of the present invention.

FIG. 2 is a flowchart illustrating a method of measuring image alignment errors for image formation according to an embodiment of the present invention. The method of measuring the image alignment errors for image formation includes operations 10 through 18 of detecting an actual error distance between two test marks from temporal measurements thereof according to a motion of a carriage.

First, the two test marks separated from each other by a designated error distance are printed on a printing medium on which images are printed in operation 10. The designated error distance represents a distance arbitrarily designated with respect to the two test marks when the two test marks are printed. The designated error distance is later needed in obtaining a value to correct an image alignment in an image forming apparatus. The two test marks are printed on the printing medium in different ways. For example, when the two test marks for correcting alignment errors caused by a difference in horizontal directions of image printing are printed, one test mark is printed on the printing medium as a carriage is moved from left to right, and the other test mark is printed on the printing medium as the carriage is moved from right to left. Alternatively, one test mark is printed using a single color cartridge, and the other test mark is printed using another color cartridge. In this case, due to a traveling error of a cartridge, a mechanical distortion, a delay time of ink ejection, and the use of cartridges discriminated for each color, the two test marks have an error distance different from the designated error distance.

After operation 10, the two test marks are sensed in operation 12. This is to substantially sense the two printed test marks.

After operation 12, instants of time when the two test marks are sensed, are measured in operation 14. Each result of the sensing of the two test marks in operation 12 is discretized, and the instants of time when the two test marks are sensed are measured using the discretized result of the sensing of the two test marks and information given by a reference clock.

After operation 14, an actual error distance of the two test marks is detected using the measured instants of time and a moving speed of the carriage in operation 16. According to whether the moving speed of the carriage is constant or variable, a method of obtaining the actual error distance includes the following two procedures. First, when the moving speed of the carriage is constant, a time difference between the measured instants of time of the two test marks is detected, and the actual error distance of the two test marks is detected by multiplying the detected time difference by the constant moving speed of the carriage. Second, when the moving speed of the carriage is variable, the actual error distance of the two test marks is detected by integrating the variable moving speed of the carriage between the measured instants of time of the two test marks and discretizing a value obtained from the integration of the variable moving speed of the carriage.

After operation 16, an image alignment correction value is detected by obtaining a distance difference between the designated error distance and the actual error distance in operation 18. The distance difference between the designated error distance of the two test marks and the actual error distance of the two test marks in operation 16, is obtained. The distance difference between the designated error distance and the actual error distance is the image alignment correction value. The image alignment correction value is an error value substantially appearing during an image printing operation, and an image having a good image alignment can be obtained by correcting this error.

Hereinafter, a structure and an operation of an apparatus for measuring the image alignment errors for image formation, which uses the method of measuring the image alignment errors for image formation as shown in FIG. 2, will be described with reference to the accompanying drawings.

Figure 3:
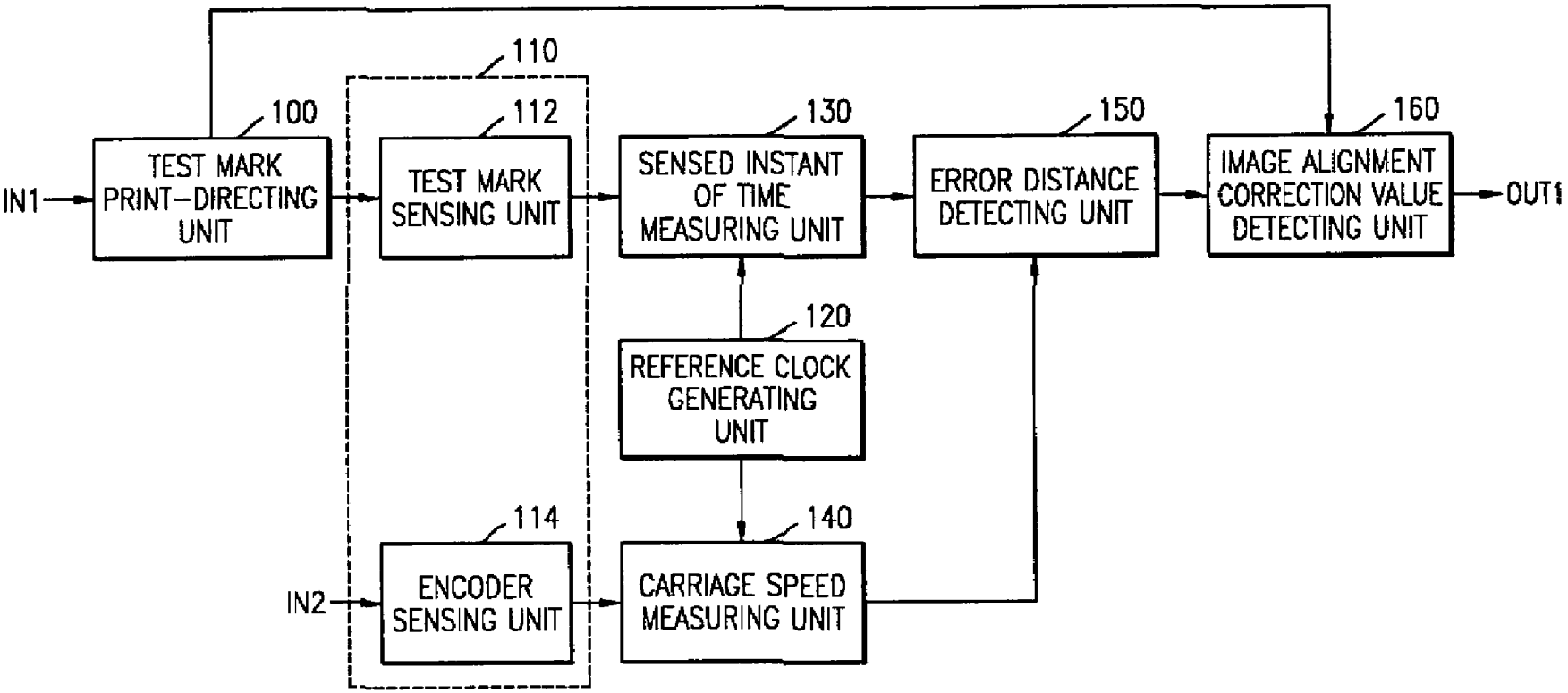
FIG. 3 is a block diagram illustrating an apparatus for measuring image alignment errors for image formation by performing the method of FIG. 2.

FIG. 3 is a block diagram illustrating the apparatus for measuring the image alignment errors for image formation. The apparatus for measuring the image alignment errors for image formation includes a test mark print-directing unit 100, a carriage 110, a test mark sensing unit 112, an encoder sensing unit 114, a reference clock generating unit 120, a sensed instant of time measuring unit 130, a carriage speed measuring unit 140, an error distance detecting unit 150, and an image alignment correction value detecting unit 160. FIGS. 4A-4E show the test marks and related signal waveforms to explain the method of measuring the image alignment errors for image formation.

In order to perform operation 10, the test mark print-directing unit 100 directs the carriage to print the two test marks separated from each other by the designated error distance on the printing medium on which images are printed. Information on the designated error distance has been previously stored on the test mark print-directing unit 100. The designated error distance is transmitted to the image alignment correction value detecting unit 160. The two test marks print-directing unit 100 directs the carriage to print the two test marks in a different method of image printing. For example, as shown in of FIG. 4A, when the test marks for image alignment are printed on a horizontal axis, the test mark print-directing unit 100 directs the carriage to print one test mark on a printing route when the carriage is moved from left to right (direction 1), and to print the other test mark on the printing route when the carriage is moved from right to left (direction 2). Alternatively, the test mark print-directing unit 100 directs the carriage to print the one test mark on the printing medium using a single color cartridge, and the other test mark is placed on the recording medium using a color cartridge. When the test mark print-directing unit 100 receives a signal required for image alignment error measurement through an input terminal IN1 and directs the carriage to print the test marks on the horizontal axis, the one test mark is printed when the carriage is moved from left to right, and the other test mark is set when the carriage is moved from right to left, and a result of printing direct is output to the test mark sensing unit 112 of a carriage 110.

The carriage 110 is provided in an ink-jet printer and includes the test mark sensing unit 112 besides a toner cartridge (not shown) and the encoder sensing unit 114.

Figures 4A, 4B, 4C, 4D, 4E:
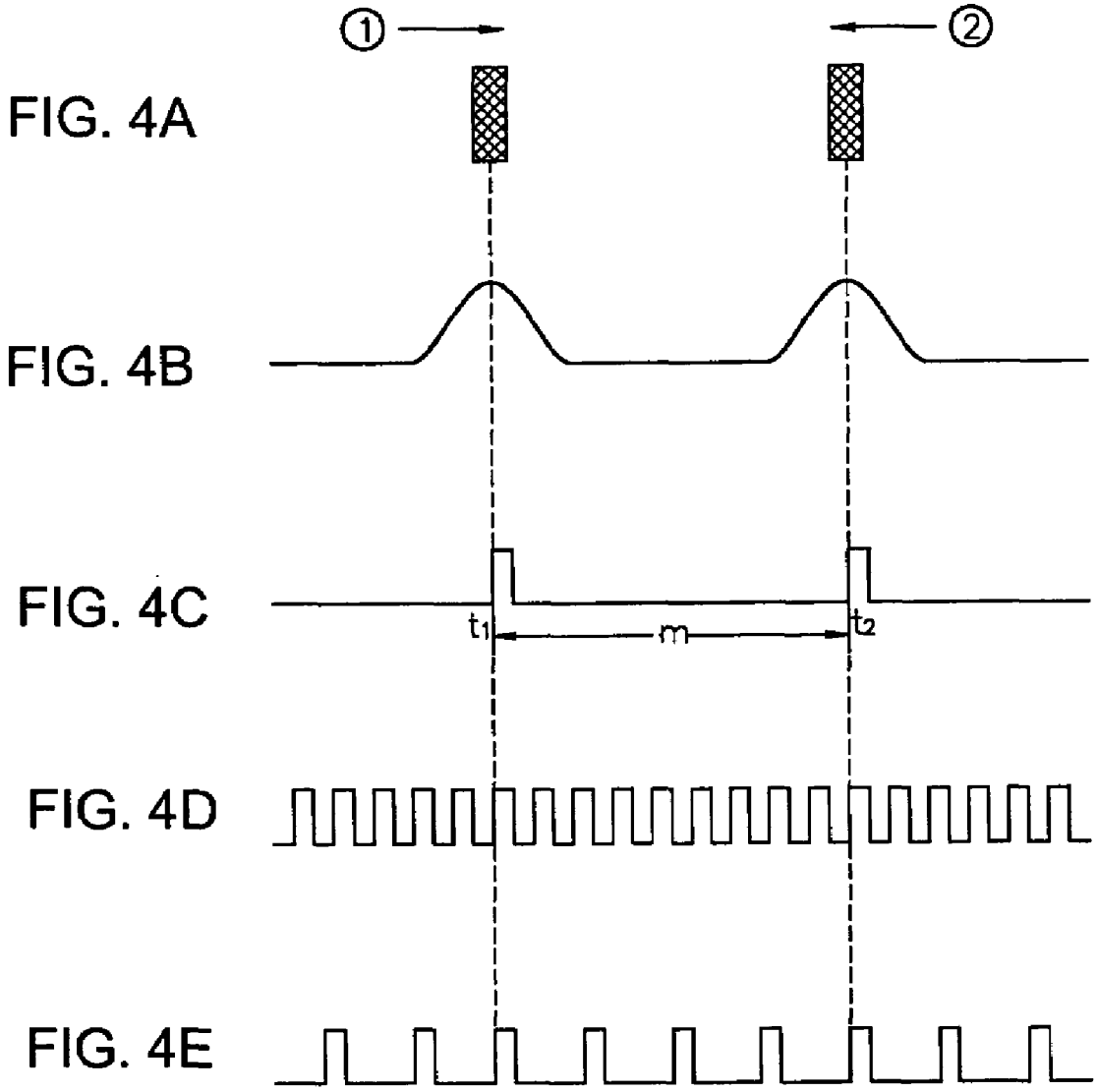
FIGS. 4A-4E are views showing test marks and related signal waveforms to explain the method of measuring the image alignment errors for image formation in the apparatus of FIG. 3.

The encoder sensing unit 114 generates an encoder pulse by sensing an encoder strip. FIG. 4E shows an encoder pulse generated from the encoder sensing unit 114. For example, the encoder sensing unit 114 senses the encoder strip input from another input terminal IN2, generates the encoder pulse, and transmits the generated encoder pulse to the carriage speed measuring unit 140.

In order to perform operation 12, the test mark sensing unit 112 senses the two printed test marks and outputs the result of sensing. The test mark sensing unit 112 substantially senses positions at which the two test marks are printed by the test mark print-directing unit 100. FIG. 4B shows each result of sensing of the test mark sensing unit 112. For example, the test mark sensing unit 112 receives the result of the printing direct from the test mark print-directing unit 100, senses the two test marks, and outputs the result of sensing to the sensed instant of time measuring unit 130.

The reference clock generating unit 120 generates a reference clock and outputs the generated reference clock. The reference clock generating unit 120 generates the reference clock at a predetermined period, so as to count a time difference between the measured instants of time of the test marks, and so as to measure the moving speed of the carriage. FIG. 4D shows the reference clock generated from the reference clock generating unit 120. The generated reference clock is transmitted to the sensed instant of time measuring unit 130 and the carriage speed measuring unit 140.

In order to perform operation 14, the sensed instant of time measuring unit 130 compares the sensed result of the two test marks with the generated reference clock in order to measure the instants of time when the two test marks are sensed, and outputs the measured instants of time. The sensed instant of time measuring unit 130 receives the sensed result from the test mark sensing unit 112 and discretizes the sensed result. For discretization, the sensed instant of time measuring unit 130 includes an A/D converter (not shown). FIG. 4C shows a diagram in which the sensed result of the sensing of the two test mark is discretized. The instants of time when the two test marks are sensed are measured from the discretized sensed result and the reference clock transmitted from the reference clock generating unit 120. FIG. 4C shows the instants of time t1 and t2 for the two measured test marks.

The carriage speed measuring unit 140 detects the moving speed of the carriage 110 and transmits the detected moving speed to the error distance detecting unit 150. The moving speed of the carriage 110 may be constant or variable. The carriage speed measuring unit 140 receives the reference clock from the reference clock generating unit 120, receives the encoder pulse from the encoder sensing unit 114, and measures the moving speed of the carriage 110 for each encoder pulse duration.

In order to perform operation 16, the error distance detecting unit 150 detects the actual error distance of the two test marks using the measured instants of time and the moving speed of the carriage, and outputs the detected actual error distance. The error distance detecting unit 150 obtains the actual error distance by discriminating the actual error distance according to whether the moving speed of the carriage 110 is constant or variable. When the moving speed of the carriage 110 is constant, the error distance detecting unit 150 detects the time difference between the measured instants of time of the two test marks transmitted from the sensed instant of time measuring unit 130, and detects the actual error distance of the two test marks by multiplying the detected time difference by the constant moving speed of the carriage 110 transmitted form the carriage speed measuring unit 140. However, when the moving speed of the carriage 110 is variable, the error distance detecting unit 150 integrates the variable moving speed of the carriage 110 transmitted from the carriage speed measuring unit 140 between the measured instants of time of the two test marks, and discretizes an integrated value, thereby detecting the actual error distance of the test marks. In FIG. 4C, m is the actual error distance.

In order to perform operation 18, the image alignment correction value detecting unit 160 detects an image alignment correction value by obtaining the distance difference between the designated error distance printed by the test mark print-directing unit 100 and the actual error distance detected by the error distance detecting unit 150 and outputs the detected image alignment correction value. The image alignment correction value is an error value of image alignment substantially appearing during an image printing operation. For example, the image alignment correction value detecting unit 160 receives the designated error distance from the test mark print-directing unit 100, receives the actual error distance detected by the error distance detecting unit 150, detects the image alignment correction value by obtaining the distance difference between the designated error distance and the actual error distance, and inputs the detected image alignment correction value to an output terminal OUT 1.

Figure 1B:
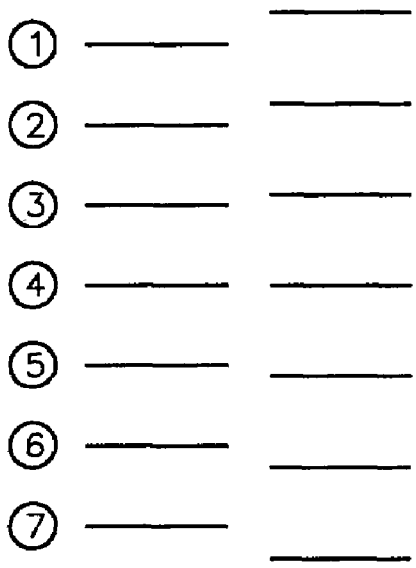
FIG. 1B (PRIOR ART)

As described above, in the method of and apparatus for measuring the image alignment errors for image formation according to the present invention, a user does not have to check the alignment of a plurality of test marks shown in FIGS. 1A and 1B, to correct the image alignment with naked eyes of the user, and errors in image alignment can be easily measured using only two test marks.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A method of measuring image alignment error for image formation in an ink-jet image forming apparatus having a carriage, the method comprising:

printing two test marks separated from each other by a designated error distance on a printing medium on which images are printed;

sensing the two test marks;

measuring instants of time when the two test marks are sensed according to a movement of the carriage; and detecting an actual error distance of the two test marks using the measured instants of time and a moving speed of the carriage, wherein the detecting of the actual error distance comprises:

integrating a variable moving speed of the carriage between the measured instants of time of the two test marks; and discretely separating the integrated value to generate the actual error distance.

2. An apparatus for measuring image alignment error for image formation in an image forming apparatus having a carriage, the apparatus comprising:

a test mark print-directing unit which directs the carriage to print two test marks separated from each other by a designated error distance on a printing medium on which images are printed;

a test mark sensing unit which senses the two test marks and outputs a sensed result of the two test marks:

a reference clock generating unit which generates a reference clock and outputs the generated reference clock;

a sensed instant of time measuring unit which compares the sensed result of the two test marks with the generated reference clock to measure instants of time when the two test marks are sensed according to a movement of the carriage, and outputs the measured instants of time and an error distance detecting unit which detects an actual error distance of the two test marks using the measured instants of time and a moving speed of the carriage, and outputs the detected actual error distance, wherein the error distance detecting unit integrates the variable moving speed of the carriage between the measured instants of time of the two test marks to generate an integrated value, discretizes the integrated value, and detects the actual error distance.

3. An apparatus for measuring an image alignment error for image formation in an image forming apparatus having a carriage, the apparatus comprising:

a test mark print-directing unit which directs the carriage to print first and second test marks on a printing medium according to a designated error distance;

a test mark sensing unit which senses the first and second test marks and outputs first and second sensed results of the first and second test marks:

a sensed instant of time measuring unit which measures instants of time when the first and second test marks are sensed, according to the first and second sensed results, and outputs the measured instants of time; and an error distance detecting unit which detects an actual error distance of the first and second test marks using the measured instants of time to compensate for the image alignment error according to the actual error distance of the first and second test marks, wherein the moving speed of the carriage is variable during printing the first and second test marks, and the error distance detecting unit calculates values representing the variable moving speed of the carriage between the measured instants of time and generates the actual error distance according to the values.

4. An apparatus for measuring an image alignment error for image formation in an image forming apparatus having a carriage, the apparatus comprising:

a test mark print-directing unit which directs the carriage to print first and second test marks on a printing medium according to a designated error distance;

a test mark sensing unit which senses the first and second test marks and outputs first and second sensed results of the first and second test marks:

a sensed instant of time measuring unit which measures instants of time when the first and second test marks are sensed, according to the first and second sensed results, and outputs the measured instants of time; and an error distance detecting unit which detects an actual error distance of the first and second test marks using the measured instants of time to compensate for the image alignment error according to the actual error distance of the first and second test marks, wherein the error distance detecting unit detects whether the moving speed of the carriage is constant or variable, uses a reference clock signal and a movement of the carriage to generate the actual error distance using one of first and second calculation methods selected in response to determining that the moving speed of the carriage is constant or variable.

5. The apparatus of claim 4, wherein the carriage moves in a first direction, the printing medium moves in a second direction, and the first and second test marks are printed in one of the first and second directions.

6. The apparatus of claim 4, wherein the carriage moves with respect to the printing medium to print an image in another printing direction according to a difference between the actual error distance and the designated error distance.

* * * * *

UNITED STATES PATENT AND TRADEMARK OFFICE

CERTIFICATE OF CORRECTION

PATENT NO. : 7,328,959 B2
APPLICATION NO. : 10/611422
DATED : February 12, 2008
INVENTOR(S) : Young-sun Chun It is certified that error appears in the above-identified patent and that said Letters Patent is hereby corrected as shown below:

On the Title Page, Item (54) (Title), line 1, after "OF" insert --AND--.

Column (Title), Line 1, after "OF" insert --AND--.

Column 7, Line 6, change "marks:" to --marks;--.

Column 7, Line 14, after "time" insert --;--.

Column 8, Line 15, change "marks:" to --marks;--.

Column 8, Line 27, before "uses" insert --and--.

Signed and Sealed this

Eighth Day of July, 2008

JON W. DUDAS
*Director of the United States Patent and Trademark Office*